United States Patent [19]

Nyce

[11] Patent Number: 4,591,482

[45] Date of Patent: May 27, 1986

[54] PRESSURE ASSISTED SINTER PROCESS

[75] Inventor: Andrew C. Nyce, Cape Elizabeth, Me.

[73] Assignee: Gorham International, Inc., South Windham, Me.

[21] Appl. No.: 771,199

[22] Filed: Aug. 29, 1985

[51] Int. Cl.[4] ..... B22F 1/00

[52] U.S. Cl. ..... 419/38; 419/23; 419/42; 419/53; 419/54; 419/60; 419/48; 419/49; 148/37; 148/135; 148/126.1; 148/133

[58] Field of Search ..... 419/30, 38, 53, 54, 419/23, 42, 60, 48, 49; 148/37, 135, 126.1, 133

[56] References Cited

U.S. PATENT DOCUMENTS 4,331,477 5/1982 Kubo et al. ..... 419/54

4,478,790 10/1984 Hüther et al. ..... 419/54

*Primary Examiner*—Stephen J. Lechert, Jr.

*Attorney, Agent, or Firm*—Jerry Cohen; M. Lawrence Oliverio

[57] ABSTRACT

Pressure assisted sintering achieves full densification in short sinter times with low grain growth. This result is enabled by a stage of sintering to a condition of closed porosity (14) followed by a pressure assisted sinter (PAS) stage (16) carried out at a temperature close to, but just below, sinter temperature. Advantageously a small melt formation is induced by a brief temperature spiking (18) during the PAS stage to enable collapse of voids.

16 Claims, 2 Drawing Figures

PRESSURE ASSISTED SINTER PROCESS

BACKGROUND OF THE INVENTION

The present invention relates to consolidation and densification of metal alloy powders.

The field of the invention comprises production of metal parts from powders to achieve essentially full density, i.e., 98–100% of theoretical density. The prior art approaches to such production are troubled by high capital and operating costs of high temperature and/or high pressure production equipment, and problems of grain growth during production.

In many applications of sintered powder metallurgy (PM) parts, essentially full density is required to meet requirements for fatigue strength, ductility, ultimate tensile strength, impact strength, corrosion resistance and hardness which are typically exhibited by cast, forged or wrought parts. Such fully dense PM parts heretofore have been made using powder metallurgy methods involving high temperature vacuum sintering which is considered expensive and difficult to control. Generally, vacuum sintering yields a wide uncontrolled distribution of sintered densities between 94 and 98.5 percent of theoretical. Another approach which has been used with the alloys Ti-6Al-$_4$V, Monel, M-2, 4600, 4650, 316L, Stellite 21 and Stellite 6 comprises processing to full density by first pressing suitably prepared alloy metal powders and sintering them to a condition of closed porosity, usually about 92 percent of theoretical density, followed by hot isostatic pressing ("HIP") at 15,000 psi and temperatures 100° to 300° C. below the sintering temperatures for closed porosity.

With this method, the problems of achieving full density were essentially solved. However, the cost of high pressure HIP equipment was a major deterrent to using this method in production.

Processes, and equipment, per se, for sintering, die pressing and/or isostatic pressing, per se and in hybrid combinations are well known for consolidation and densification of powder compacts to over 95% of theoretical density. The compact so treated may be a simple geometric form, such as a cube, or a complex shaped part.

It is the object of the invention to provide technical and economical feasibility for metal alloy parts PM production through a modified form of sintering described herein overcoming the above problems.

SUMMARY OF THE INVENTION

The invention comprises low-pressure assisted sintering of a metal alloy powder compact with low pressure. The cost of the pressure vessel and associated compressors and control valves are considerably less under such processing than for high pressure HIP equipment and operating costs for gas will be substantially less at low pressure. The ability to apply the low pressure almost instantaneously is a considerable advantage in many ways. In pressure assisted sintering (PAS), the pressure is applied immediately (or the equivalent of immediately, i.e., recreating the condition of pre-hold after a long time hold) after sintering a pressed compact to closed porosity (93 to 95% of theoretical density). In this process the applied processing pressure for pressure-assisted sintering, is an order of magnitude less than would be required in conventional HIP and at a temperature equal or nearly equal to the sinter temperature within minus 20% to plus 10%, preferrably within minus 10% to plus 5%. Densification to 98–99% of theoretical density of the metal is achieved via pressure assistance of the sintering, at pressures between 1,000 and 3,000 psi. The powder mixture can be performed as an alloy or comprise a mixture of metal alloy elemental components. Master alloy portions can also be included.

A closed porosity is established in the initial long sintering step and collapsed during the follow-on, short, pressure assisted step. The two steps together comprise about 40–70% of the time needed for conventional sintering. In use of the invention for some metals a temperature spike may be induced during the pressure assistance portion of the sintering (preferrably early in such portion, during the rise from ambient to 2000 psi) to weaken the body, so that applied pressure collapses remaining voids; this tends to reduce the needed time of pressure assistance. Inert gas pressure is applied (with or without the temperature spike) in the range of 1,000 to 3,000 psi for a period of time sufficient to allow complete densification. The pressure is preferrably applied at or near the sintering temperature immediately following the attainment of closed porosity. But interruptions are tolerable if cool down and very rapid re-heat can be achieved.

Both the initial sintering without pressure and follow-on pressure sintering steps should be carried out in the same pressure-furnace with the two stages immediately concurrent. Alternatively, the process can be carried out in two stages in two separate systems.

The compressive yield strength of the material surrounding residual voids is substantially reduced to below the applied pressure and densification occurs quickly thereby avoiding excessive grain growth. The temperature spike when used to overcome resistance and/or to shorten the necessary pressure assist stage may last for a duration of seconds to minutes.

The process conditions of the invention avoid excessive grain growth, while enabling full densification of metal alloys produced to complex forms at low cost.

Other ojects, features, and advantages will be apparent from the following detailed description of preferred embodiments taken in conjunction with the accompanying drawing in which:

DETAILED DESCRIPTION OF PREFERRED EMBODIMENTS

Figure 1:
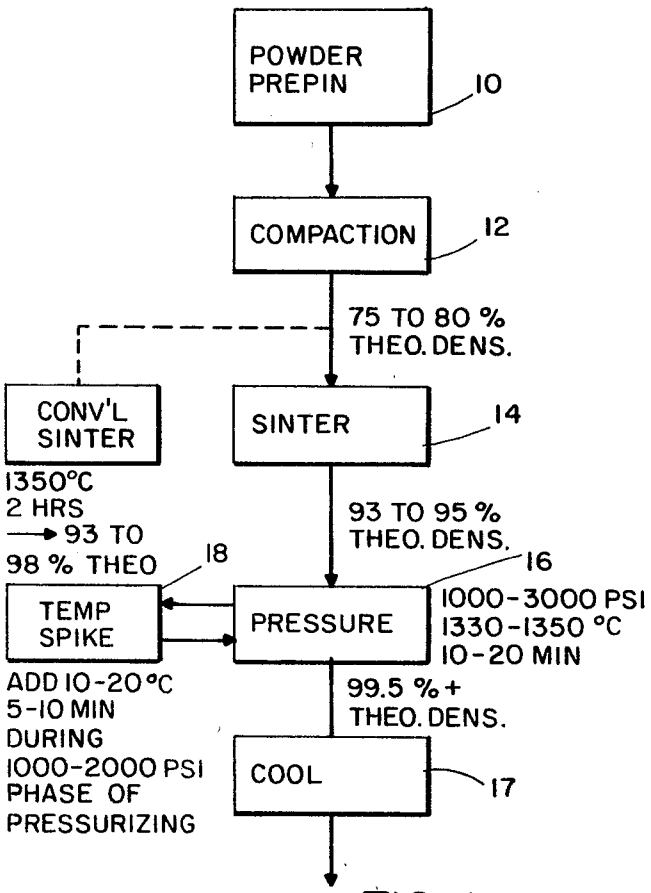
FIG. 1 is a flow chart of powder processing in accordance with the invention.

In accordance with preferred embodiments of the invention, powders of metal alloy are prepared by size selection, pouring into a mold and pressing to form a compact of 75–80% theoretical density as shown at blocks 10–12 (FIG. 1). The compact is sintered at (e.g., for stainless steel) 1350 degrees C. in a vacuum or reactive gas furnace to produce a densified compact (93–95% of theoretical density, as indicated in block 14).

The compact can be contained in a sealed cannister within the sinter furnace or alternatively made self supporting as an initial pressed compact. After the initial sintering stage, the pressurization can be applied in a separate chamber with a rapid transfer of the compact or in the original sinter chamber. The chamber is pressurized to 1000–3000 psi (step 16) and the compact is maintained at a temperature just under the original sinter heating temperature. The compact is maintained at such pressure and temperature for an hour and then returned to ambient pressure and temperature (step 17) by gradual pressure release and nonforced cooling in an inert gas atmosphere. Alternatively, a moderate amount of post pressure sinter (i.e., very slow cooling) can be applied for some alloys. This HIP step has the effect of increasing density to over 98% of theoretical, depending on the alloy so treated.

The step 10 of powder preparation may involve production of fine, non-crystalline or micro-crystalline forms of the powder, via metal atomization or the like to yield controlled, a fine particle size of the powder below 44 microns (−325 Mesh), preferably below 10 microns. The block 12 compaction can be, e.g., at 60 tons per square inch, in a mold. Sintering provides 93–95% densification and full densification is provided in the following pressure assisted sinter treatment. Block 18 indicates the temperature spike optimally induced during the pressure assisted portion of the sinter cycle to assure collapse of voids. Essentially, the temperature during the latter step is about 100°–200° C. below the first step sinter temperature except for the temperature spike which may be back to the sinter temperature but which is held only for a short time (e.g., 5–10 minutes) to avoid significant grain growth.

Figure 2:
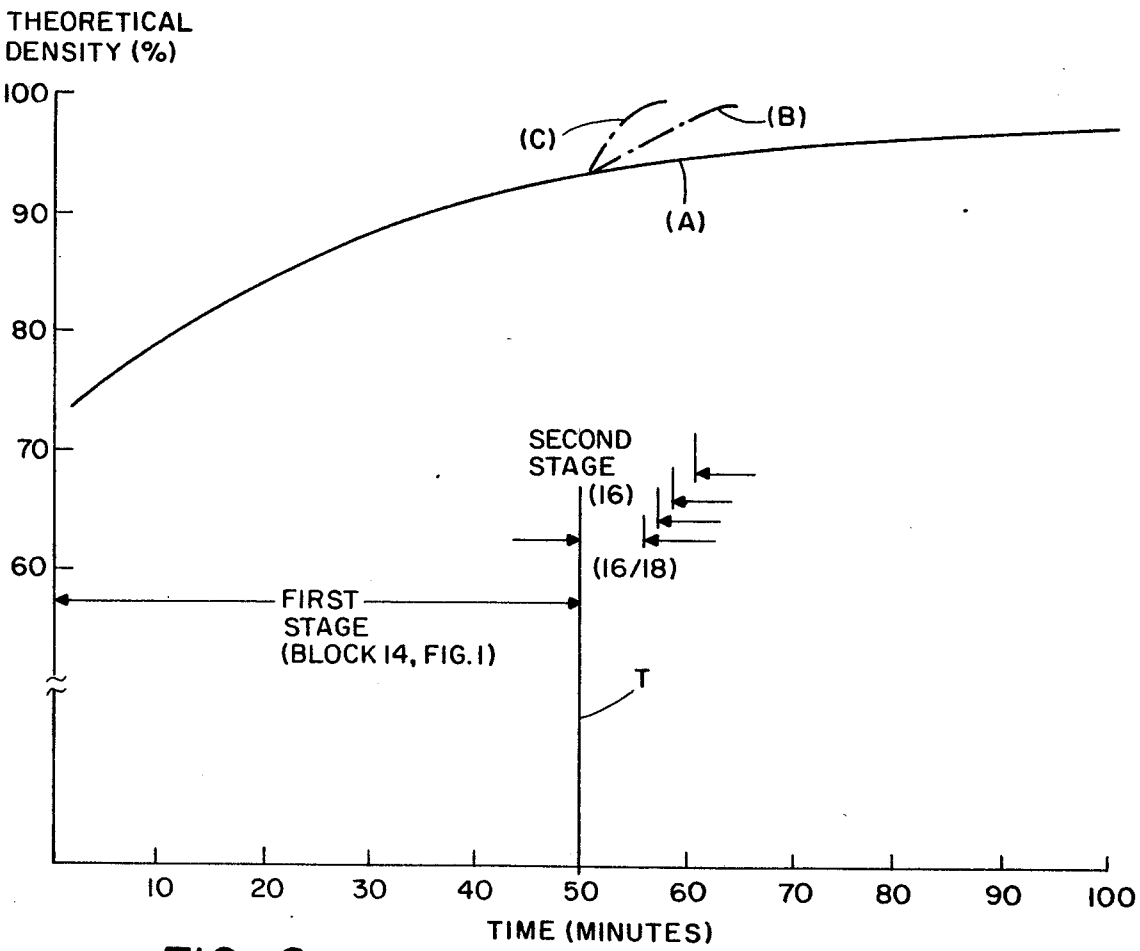
FIG. 2 is an illustration of what would be a typical product density time diagram realized through (A) conventional sintering, (B) pressure assisted sintering; and (C) the latter with a temperature spike.

FIG. 2 shows the density (in % of theoretical) vs. time (hours) profile for an alloy with curve A showing the actual showing the increase which would occur in conventional sinter processing and B and C representing the density-time profiles achieved for sintering with pressure applied at time T (curve B) and application of pressure and a temperature spike (curve C).

The metal alloys treatable through the invention include steels (stainless and low carbon), superalloys and other nickel base alloys, rare-earth-base alloys (e.g., samarium-neodynium, samarium-cobalt), aluminum or copper base alloys, titanium (e.g., Ti-6Al-4V) and other refractory metal base alloys. The resultant compacts can be intermediate blanks of simple geometric forms or essentially finished pieces, e.g., tool cutting edge, airfoil, turbine blade, of complex form—and in either case achieved at net or near net dimensions and surface finish.

EXAMPLES (I) Several alloys (1. Ti-6Al-4V; 2. M-2 tool steel; S. Stellite 21; 6.98 Sm-1.1 Nd/rare earths-0.9 Co) were sintered for two hours and then HIP processed for an hour to achieve densities after the first two hours and third hour as shown in Table 1. The work was done at separate times (with a three year interval) between groups of tests. It is apparent in retrospect that a precursor of the present invention is implicit in the data. The 1000–2000 psi (2K psi) processing runs 1-1, 1-5, 1-8, 2-1, 2-4, 3-1, 3-4, 5-1, 5-4, 6-4 is beneficial compared to 15,000–30,000 psi of other runs, e.g., 1-2, 1-3, 2-2, 2-3, etc.

TABLE

SUMMARY OF HIP'ING RESULTS TABLES 1–6 AND COMPARISON TO PREVIOUS WORK

| | | Sintering | | Hot Isostatic Pressing | | | % Theoretical Density | |
|---|---|---|---|---|---|---|---|---|
| Run # | Material | Temp °C. | Time Hrs | Temp °C. | Pressure KPSI | Time Hrs | Sintered | HIP'ed |
| 1-1 | Ti—6Al—4V | 1230 | 2 | 1000 | 2.0 | 1 | 92.27 | 99.41 |
| 1-2 | Ti—6Al—4V | 1230 | 2 | 1000 | 15.0 | 1 | 92.27 | 99.48 |
| 1-3 | Ti—6Al—4V | 1230 | 2 | 1000 | 30.0 | 1 | 92.27 | 99.38 |
| 1-4 | Ti—6Al—4V | 1100 | 2 | 900 | 2.0 | 1 | 92.30 | 95.10 |
| 1-5 | Ti—6Al—4V | 1100 | 2 | 1000 | 2.0 | 1 | 92.30 | 99.30 |
| 1-6 | Ti—6Al—4V | 1120 | 2 | 1180 | 2.3 | 1 | 93.20 | 99.30 |
| 1-7 | Ti—6Al—4V | 1120 | 2 | 1000 | 2.3 | 1 | 93.00 | 99.10 |
| 1-8 | Ti—6Al—4V | 1120 | 2 | 1000 | 1.3 | 1 | 93.00 | 98.60 |
| 2-1 | M-2 Tool Steel | 1230 | 2 | 1100 | 2.0 | 1 | 93.65 | 96.57 |
| 2-2 | M-2 Tool Steel | 1230 | 2 | 1100 | 15.0 | 1 | 89.89 | 99.20 |
| 2-3 | M-2 Tool Steel | 1230 | 2 | 1100 | 30.0 | 1 | 89.89 | 99.03 |
| 2-4 | M-2 Tool Steel | 1210 | 2 | 1240 | 1.0 | 1 | 94.40 | 98.50 |
| 2-5 | M-2 Tool Steel | 1210 | 2 | 1235 | 1.0 | 1 | 94.00 | 97.70 |
| 3-1 | 316L Stainless | 1370 | 2 | 1100 | 2.0 | 1 | 96.17 | 96.24 |
| 3-2 | 316L Stainless | 1370 | 2 | 1100 | 15.0 | 1 | 95.68 | 100.00 |
| 3-3 | 316L Stainless | 1370 | 2 | 1100 | 30.0 | 1 | 95.68 | 99.41 |
| 3-4 | 316L Stainless | 1360 | 2 | 1350 | 1.0 | 1 | 95.70 | 98.10 |
| 3-5 | 316L Stainless | 1360 | 2 | 1350 | 1.0 | 1 | 95.70 | 97.90 |
| 4-1 | 4650 Alloy Steel | 1350 | 2 | 1300 | 2.0 | 1 | 95.23 | 97.52 |
| 4-2 | 4650 Alloy Steel | 1350 | 2 | 1300 | 15.0 | 1 | 94.79 | 100.00 |
| 4-3 | 4650 Alloy Steel | 1350 | 2 | 1300 | 30.0 | 1 | 97.52 | 99.96 |
| 4-4 | 4650 Alloy Steel | 1370 | 2 | 1350 | 1.0 | 1 | 95.30 | 97.50 |
| 4-5 | 4650 Alloy Steel | 1370 | 2 | 1360 | 1.0 | 1 | 95.30 | 98.40 |
| 5-1 | Stellite ® 21 | 1350 | 2 | 1300 | 2.0 | 1 | 92.43 | 93.23 |
| 5-2 | Stellite ® 21 | 1350 | 2 | 1300 | 15.0 | 1 | 92.57 | 99.83 |
| 5-3 | Stellite ® 21 | 1350 | 2 | 1300 | 30.0 | 1 | 93.23 | 100.00 |
| 5-4 | Stellite ® 21 | 1350 | 2 | 1300 | 2.0 | 1 | 92.60 | 93.30 |
| 5-5 | Stellite ® 21 | 1340 | 2 | 1300 | 2.0 | 1 | 92.60 | 93.00 |
| 6-1 | Rare Earth Cobalt Magnets* | 1140 | 1 | 950 | 15.0 | 1 | 97.6 | 100.00 |
| 6-2 | Rare Earth Cobalt Magnets | 1140 | 1 | 950 | 15.0 | 1 | 95.50 | 100.00 |
| 6-3 | Rare Earth Cobalt Magnets | 1140 | 1 | 1120 | 1.0 | 1 | 97.60 | 98.90 |
| 6-4 | Rare Earth Cobalt Magnets | 1140 | 1 | 1120 | 1.0 | 1 | 95.60 | 99.10 |

(II) The invention preferably uses compressed time conditions of FIG. 2 compared to the extended times of conventional sintering or the Table I hybrid processes. As an example, for a low temperature sinter alloy (circa 350° C., compared to the steel circa 1200° C. processing) an alloy with a recrystallization temperature of 300° C. can be heated up to 290° C. in a few minutes (1–2) and maintained at such temperature for the balance of 50 minutes (First Stage, FIG. 2), then exposed at such time to pressure of 1500 psi and temperature spike of 30° C. being in effect a 10°–20° C. spike, because the alloy might cool about 10°–20° C. from the 290° C. temperature as cool pressurizing gas is admitted to the sintering chamber (or heat is lost in transfer of the compact between different First Stage and Second Stage vessels). The then high density of the compact facilitates heat transfer in the compact. In any event the pressure at the increased temperature, exceeds the compressive yield strength of the compact in the region(s) of its porosity. The temperature spike is terminated in five minutes and the pressure at or shortly after the same time.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. Method of formation of metal parts comprising the steps of:

(a) forming an alloy metal powder compact;

(b) heating the compact to a condition of sinter bonding; and (c) extending the sintering of the compact to achieve a density over 98% theoretical density at a temperature within minus 5–10% to plus 3–5% of the temperature of (b) under an applied pressure in the range 1,000 to 3,000 psi over a period of 5–20 minutes.

2. Method in accordance with claim 1 wherein the step (c) incorporates a temperature spiking increase of 50° C.–200° C. of 1–5 minutes.

3. Method in accordance with claim 1 wherein the steps (b) and (c) comprise essentially a continuous heating process.

4. Method in accordance with claim 1 wherein the metal powder so treated is an alloy of titanium-aluminum-vanadium.

5. Method in accordance with claim 1 wherein the metal powder so treated is a low carbon steel.

6. Method in accordance with claim 1 wherein the metal powder so treated is a nickel alloy.

7. Method in accordance with claim 1 wherein the metal powder so treated in stainless steel.

8. Method in accordance with claim 1 wherein the metal powder so treated is a cobalt-samarium alloy.

9. Method in accordance with claim 1 wherein the metal powder so treated is a samarium-neodynium alloy.

10. Method in accordance with claim 1 wherein the metal powder so treated is a superalloy.

11. Method in accordance with claim 1 wherein the metal powder so treated is a rare earth base alloy.

12. Method in accordance with claim 1 wherein the metal powder so treated is an aluminum base alloy.

13. Method in accordance with claim 1 wherein the metal powder so treated is a copper base alloy.

14. A metal alloy part of complex form as produced by the process of claim 1.

15. The product of claim 14 as a refractory metal alloy in the form of a turbine blade.

16. The product of claim 14 as a refractory metal alloy in the form of an aircraft airfoil.

* * * * *